US006892624B2

(12) United States Patent
Schoenmeyr et al.

(10) Patent No.: US 6,892,624 B2
(45) Date of Patent: May 17, 2005

(54) ENHANCED WOBBLE PLATED DRIVEN DIAPHRAGM PUMP

(75) Inventors: Ivar L. Schoenmeyr, San Juan Capistrano, CA (US); William V. Stucker, La Mirada, CA (US)

(73) Assignee: Aquatec Water Systems, Inc., Irvine, CA (US)

( * ) Notice: Subject to any disclaimer, the term of this patent is extended or adjusted under 35 U.S.C. 154(b) by 0 days.

(21) Appl. No.: 10/342,727

(22) Filed: Jan. 14, 2003

(65) Prior Publication Data

US 2003/0209138 A1 Nov. 13, 2003

Related U.S. Application Data

(60) Provisional application No. 60/379,452, filed on May 9, 2002.

(51) Int. Cl.[7] ..... F01B 19/00
(52) U.S. Cl. ..... 92/96; 92/100
(58) Field of Search ..... 92/48, 96, 103 R, 92/103 F, 103 SD

(56) References Cited

U.S. PATENT DOCUMENTS 5,649,809 A * 7/1997 Stapelfeldt ..... 92/100
5,706,715 A * 1/1998 Schoenmeyr ..... 92/96
5,724,881 A * 3/1998 Reynolds ..... 92/100
6,145,430 A * 11/2000 Able et al. ..... 92/100
6,343,539 B1 * 2/2002 Du ..... 92/100

* cited by examiner

*Primary Examiner*—Thomas E. Lazo
(74) *Attorney, Agent, or Firm*—Ben J. Yorks; Irell & Manella LLP

(57) ABSTRACT

A pump that has a flexible liner located adjacent to a diaphragm. The liner provides structural support for the diaphragm. The flexible liner can slide relative to the diaphragm. This relative movement reduces the stiffness of the diaphragm/liner assembly. The diaphragm/liner assembly is therefore both flexible and strong. Additionally, the liner provides a thermal insulator for the diaphragm. The flexible liner may be constructed from a low friction material to lower the friction between the liner and a wobble plate of the pump. Lowering the friction reduces the heat generated within the pump. The structural reinforcement, thermal insulation and lower friction features of the liner increase the life of the diaphragm and the pump.

18 Claims, 4 Drawing Sheets

ENHANCED WOBBLE PLATED DRIVEN DIAPHRAGM PUMP

REFERENCE TO CROSS-RELATED APPLICATIONS

This application claims priority to Application No. 60/379,452 filed on May 9, 2002.

BACKGROUND OF THE INVENTION

1. Field of the Invention

The present invention relates to a pump.

2. Background Information

Pumps are typically used to pump fluid through a hydraulic system. There are various types of pumps including positive displacement and variable displacement pumps. Positive displacement pumps typically include a piston(s) that moves in a reciprocating manner to pull fluid into a pumping chamber and pump the fluid out of the chamber. Wobble plate positive displacement pumps have multiple pistons that are coupled to the output shaft of an electric motor by a wobble plate. The wobble plate includes a cam surface that cooperates with a bearing assembly to simultaneously move the pistons within the pumping chambers in a manner to continuously pump fluid from the pump.

Wobble plate pumps contain a diaphragm that seals the pumping chambers of the pump. The diaphragm moves with the reciprocating pistons and thus undergoes a continuous stressing cycle. The stressing cycle can cause fatigue and failure of the diaphragm, resulting in leaking and possibly in-operation of the pump. Some wobble plate pumps have a space between the wobble plate and the outside housing wall of the pump. During certain pumping positions the diaphragm may actually bulge into the space, creating additional stress and shortening the life of the diaphragm.

The bulging effect limits the pressure at which the pump can operate. The operating pressure can be increased by designing a thicker diaphragm or by attaching a reinforcing liner. Unfortunately, increasing the thickness of the diaphragm or bonding a reinforcing liner increases the diaphragm stresses. Selecting the diaphragm thickness always requires a trade off between operating pressure and diaphragm stresses.

BRIEF SUMMARY OF THE INVENTION

A pump that includes a flexible liner adjacent to a diaphragm. The diaphragm is coupled to a piston located within a pumping chamber of the pump.

DETAILED DESCRIPTION OF THE PREFERRED EMBODIMENT

Disclosed is a pump that has a flexible liner located adjacent to a diaphragm. The liner provides structural support for the diaphragm. The flexible liner can slide relative to the diaphragm. This relative movement reduces the stiffness of the diaphragm/liner assembly. The diaphragm/liner assembly is therefore both flexible and strong. Additionally, the liner provides a thermal insulator for the diaphragm. The flexible liner may be constructed from a low friction material to lower the friction between the liner and a wobble plate of the pump. Lowering the friction reduces the heat generated within the pump. The structural reinforcement, thermal insulation and lower friction features of the liner increase the life of the diaphragm and the pump.

Figure 1:
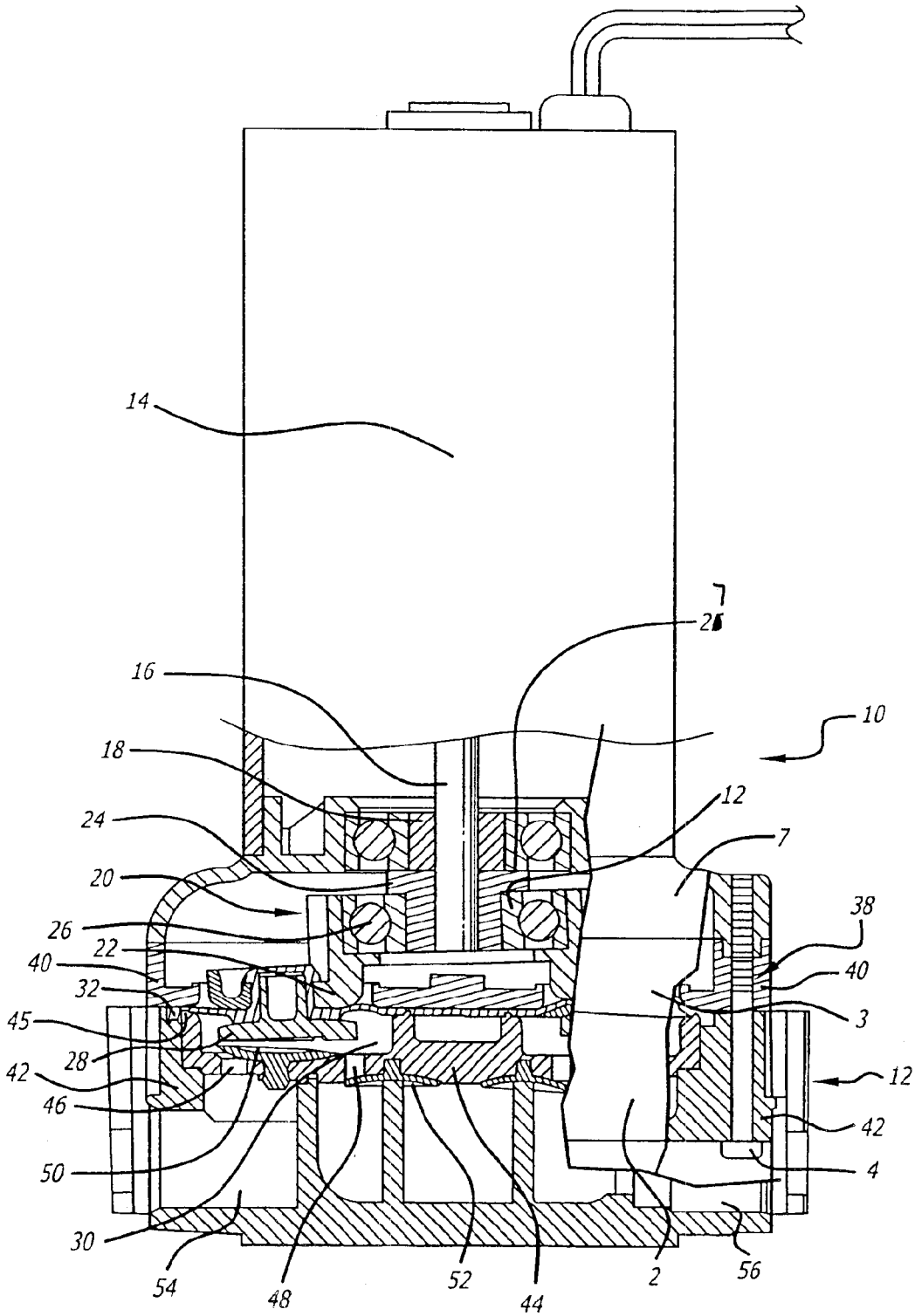
FIG. 1 is a cross-sectional view of a pump of a pump assembly.
Figure 2:
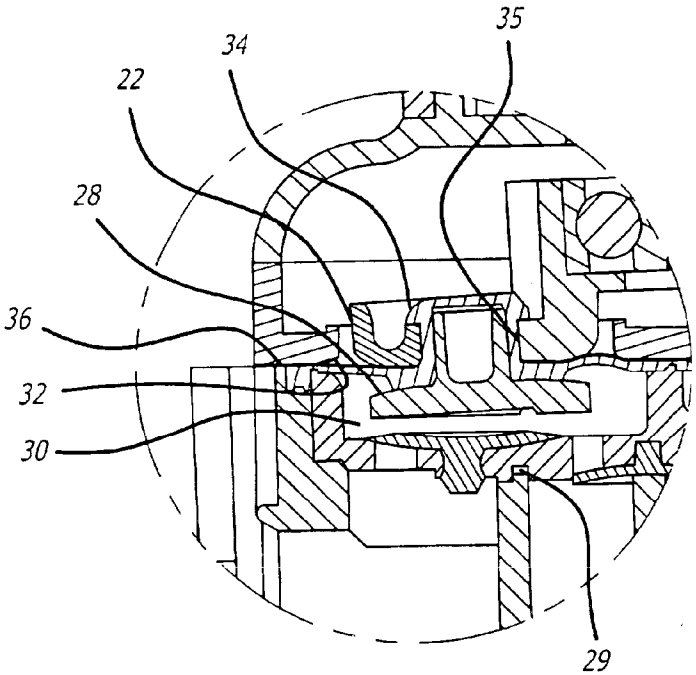
FIG. 2 is an enlarged cross-sectional view of a pump chamber of the pump.

Referring to the drawings more particularly by reference numbers, FIGS. 1 and 2 show an embodiment of a pump assembly 10. The assembly 10 includes a pump 12 that is attached to a motor 14. The motor 14 may be an electric device that has an output shaft 16. The output shaft 16 may extend through a motor bearing assembly 18 of the motor 14. The output shaft 16 may be attached to a wobble plate 20.

The wobble plate 20 may include a rocker arm 22 that is coupled to a cam plate 24 by a bearing assembly 26. The output shaft 16 is attached to the cam plate 24. The cam plate 24 has a cam surface 27 that cooperates with the motor bearing assembly 18 to induce an up and down motion of the rocker arm 22 when the plate 24 is rotated by the output shaft 16 of the motor 14.

The pump 12 includes a plurality of pistons 28 that are attached to the rocker arm 22. Each piston 28 is located within a corresponding pumping chamber 30. By way of example, the pump 12 may have five pistons 28 and corresponding pump chambers 30, although it is to be understood that there may be a different number of pistons 28 and chambers 30.

As shown in FIG. 2, the pump chambers 30 may be sealed by a diaphragm 32. The diaphragm 32 may include a plurality of stems 34 that are pressed into corresponding openings 35 of the rocker arm 22. The pistons 28 may be pressed into the stems 34 of the diaphragm 32. The diaphragm 32 may be constructed from a flexible material having a shore hardness of 60–90 Shore A and have a length to thickness aspect ratio between 5–10:1. By way of example, the diaphragm 32 may be constructed from SANTOPRENE or GEOLAST.

The diaphragm 32 may be reinforced by a flexible liner 36. The liner 36 may be constructed from an ultra high molecular weight poly-ethylene material with an aspect ratio between 25–35:1. The flexible liner 36 is preferably a low friction material to minimize friction with any part in moving contact with the liner 36. Additionally, the rocker arm 22 may be constructed from a metal with a low friction coating.

The liner 36 is not attached to the diaphragm 32 so the two members 32 and 36 can slide relative to each other. The liner 36 increases the strength of the diaphragm 32 without making the diaphragm thicker. Thus the composite diaphragm/liner can withstand more pressure without increasing the stresses on the diaphragm 32. In addition to providing structural reinforcement, the liner 36 also provides thermal insulation for heat generated by the wobble plate 20. The low friction characteristic of the liner 36 also reduces friction generated heat within the pump.

The pump 12 has a housing 38 that may include a first shell 40 and a second shell 42. The diaphragm 32 and liner 36 may be pressed between the interface of the first 40 and second 42 shells of the housing 38. A manifold 44 may be coupled to the second shell 42 of the housing 38. The diaphragm 32 may be further pressed between the manifold 44 and the first shell 40. The second housing shell 42 and manifold 44 may have protrusions 45 to facilitate the clamping of the diaphragm 32 and liner 36.

The manifold 44 may have a plurality of intake openings 46 and a plurality of outlet openings 48. Flow through the intake openings 46 may be controlled by a plurality of intake valves 50. Flow through the outlet openings 48 may be controlled by a plurality of outlet valves 52. Fluid flows into the pump 12 through an inlet port 54. Fluid flows out of the pump 12 through an outlet port 56.

In operation, the output shaft 16 of the motor 14 rotates and moves the rocker arm 22 in a reciprocating manner. As shown in FIGS. 3, 4, 5 and 6 movement of the rocker 12 moves the pistons 28 from an intake cycle position shown in FIG. 4 to an output cycle position shown in FIG. 6. In the intake position the pumping chamber 30 is expanded causing fluid to flow into the chamber 30 through the intake valve 50. During the output cycle the moving piston 28 pushes the fluid through the outlet valve 52.

Figure 4:
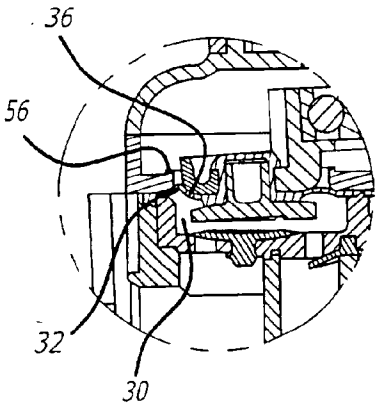
FIG. 4 is a cross-sectional view of the pump chamber in an intermediate cycle.
Figure 6:
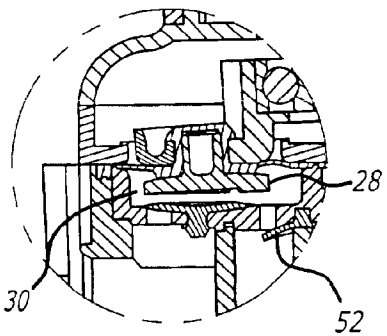
FIG. 6 is a cross-sectional view of the pump chamber during an output cycle.
Figure 3:
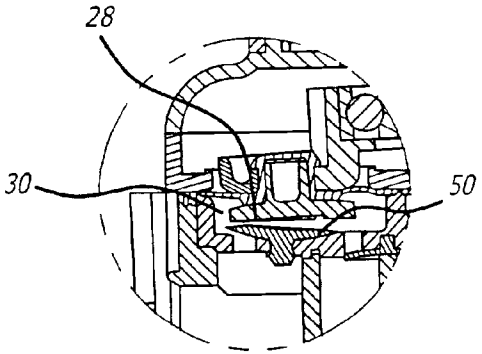
FIG. 3 is a cross-sectional view of the pump chamber during an intake cycle.
Figure 5:
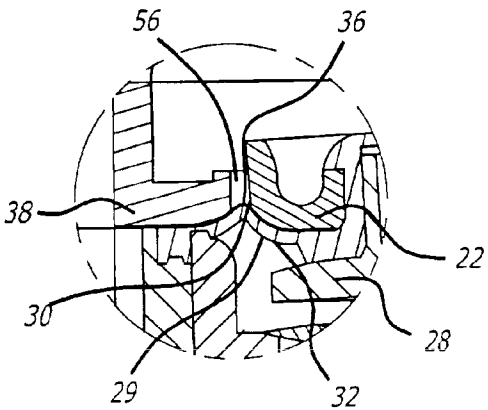
FIG. 5 is an enlarged cross-sectional view of the pump chamber shown in FIG. 4.

As shown in FIGS. 4 and 5, during an intermediate position the pressure within the pumping chamber 30 increases, causing the diaphragm 32 to bulge in a gap 56 located between the housing 38 and the rocker arm 22. The liner 36 provides structural support and limits the amount of diaphragm bulging. Limiting the diaphragm bulging reduces the stress on the diaphragm 32 and improves the life of the pump 12.

Figure 9:
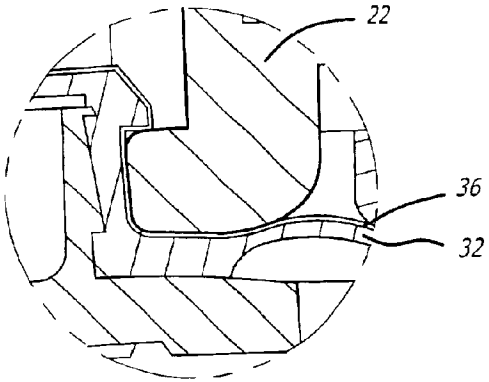
FIG. 9 is a cross-sectional view of an alternate embodiment of the pump.
Figure 8:
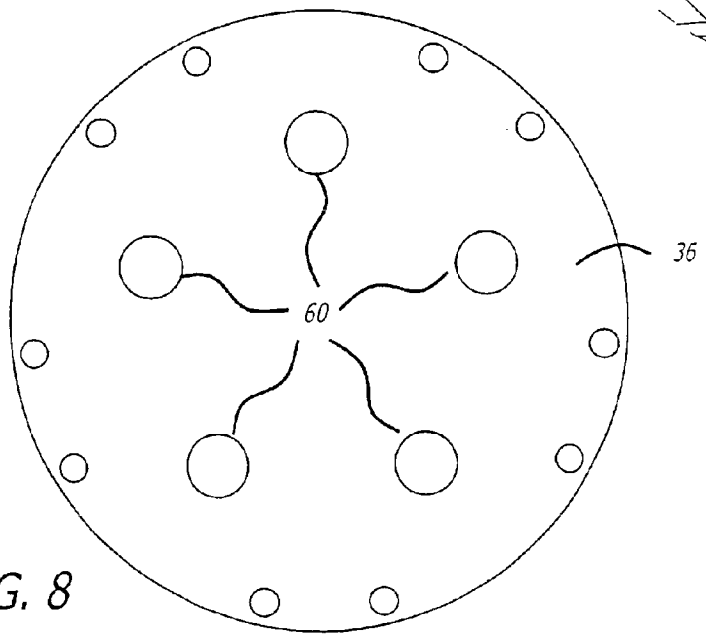
FIG. 8 is a top view of the diaphragm liner shown in FIG. 7.
Figure 7:
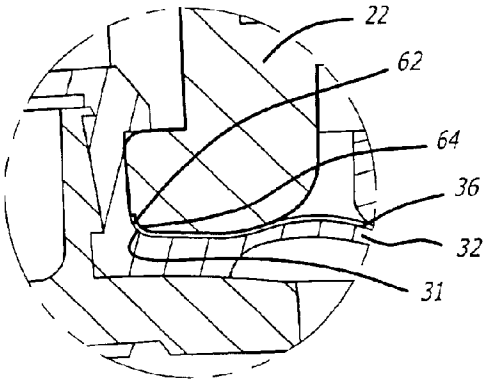
FIG. 7 is a cross-sectional view of an alternate embodiment of the pump.
Figure 10:
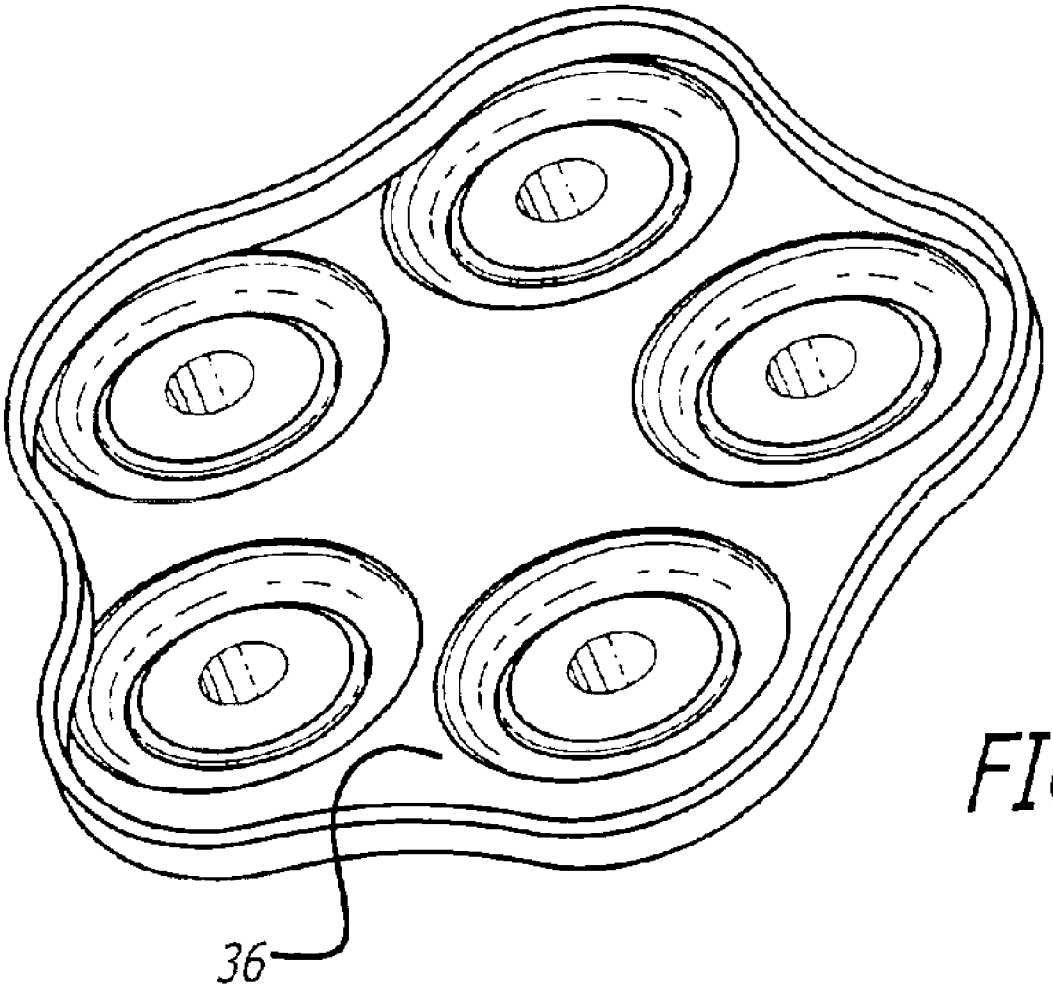
FIG. 10 is a perspective view of the diaphragm liner shown in FIG. 9.

FIGS. 7 and 8 shows an embodiment of a liner 36 that has holes 60 slightly smaller than the stems 34 of the diaphragm 32 so that the inner edges 62 of the liner 36 extend into corresponding recesses 64 of the rocker arm 22. Alternatively, as shown in FIGS. 9 and 10, the flexible liner 36 may be constructed to conform to the profile of the diaphragm 32. The liner 36 can be molded or otherwise pre-formed to conform to the diaphragm profile.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A pump, comprising:

a housing that includes a pumping chamber;

a piston located in said pumping chamber;

a wobble plate that is coupled to said piston;

a motor output shaft coupled to said wobble plate;

a diaphragm that is coupled to said piston and seals said pumping chamber; and, a flexible liner located between said wobble plate and said diaphragm.

2. The pump of claim 1, wherein said flexible liner extends along a contour of said diaphragm.

3. The pump of claim 1, wherein said housing includes a first shell and a second shell, said flexible liner being located between said first and second shells.

4. The pump of claim 1, wherein said wobble plate has a low friction coating.

5. The pump of claim 1, wherein said flexible liner includes an inner edge that extends into a recess of said wobble plate.

6. The pump of claim 1, wherein said flexible liner is constructed from a high molecular weight poly-ethylene.

7. A pump assembly, comprising:

a motor;

a housing that includes a pumping chamber, said housing being attached to said motor;

a piston located in said pumping chamber and coupled to said motor;

a wobble plate that is coupled to said piston;

a motor output shaft coupled to said wobble plate;

a diaphragm that is coupled to said piston and seals said pumping chamber; and, a flexible liner between said wobble plate and said diaphragm.

8. The pump assembly of claim 7, wherein said flexible liner extends along a contour of said diaphragm.

9. The pump assembly of claim 7, wherein said housing includes a first shell and a second shell, said flexible liner being located between said first and second shells.

10. The pump assembly of claim 7, wherein said wobble plate has a low friction coating.

11. The pump assembly of claim 7, wherein said flexible liner includes an inner edge that extends into a recess of said wobble plate.

12. The pump assembly of claim 7, wherein said flexible liner is constructed from a high molecular weight poly-ethylene.

13. A pump, comprising:

a housing that includes a pumping chamber;

a piston located in said pumping chamber;

a wobble elate that is coupled to said piston;

a motor output shaft coupled to said wobble plate;

a diaphragm that is coupled to said piston and seals said pumping chamber; and, reinforcement means for reinforcing said diaphragm and being located between said diaphragm and said wobble plate.

14. The pump of claim 13, wherein said flexible liner extends along a contour of said diaphragm.

15. The pump of claim 13, wherein said housing includes a first shell and a second shell, said flexible liner being located between said first and second shells.

16. The pump of claim 13, wherein said wobble plate has a low friction coating.

17. The pump of claim 13, wherein said flexible liner includes an inner edge that extends into a recess of said wobble plate.

18. The pump of claim 13, wherein said flexible liner is constructed from a high molecular weight poly-ethylene.

* * * * *